US005586803A

United States Patent [19]

Overpeck

[11] Patent Number: 5,586,803

[45] Date of Patent: Dec. 24, 1996

[54] PORTABLE PICNIC TABLE

[76] Inventor: Willard T. Overpeck, 171 Bellwood Ave., Wellsboro, Pa. 16901

[21] Appl. No.: 324,402

[22] Filed: Oct. 14, 1994

[51] Int. Cl.[6] ..... A47B 83/02

[52] U.S. Cl. ..... 297/158.3; 248/188.2; 16/29; 16/32; 16/40

[58] Field of Search ..... 297/158.3, 158.4, 297/158.5, 159.1; 248/188.2, 188.1; 16/32, 29, 30, 40, 18 R

[56] References Cited

U.S. PATENT DOCUMENTS

| | | | |
|---|---|---|---|
| 1,004,550 | 10/1911 | Bertke | 16/30 X |
| 2,371,460 | 3/1945 | Needham | 248/188.2 |
| 2,834,608 | 5/1958 | Wixson | 16/32 X |
| 2,848,229 | 8/1958 | Miller . | |
| 2,974,917 | 3/1961 | Kappen . | |
| 4,424,604 | 1/1984 | Dupuis | 16/29 |
| 4,932,729 | 6/1990 | Thompson et al. | 248/188.2 X |
| 4,974,284 | 12/1990 | Campbell . | |
| 5,154,441 | 10/1992 | White . | |
| 5,330,064 | 7/1994 | Hall | 16/29 X |

FOREIGN PATENT DOCUMENTS

| | | | |
|---|---|---|---|
| 857145 | 12/1970 | Canada | 16/30 |
| 473902 | 10/1914 | France | 16/29 |
| 948165 | 1/1949 | France | 16/40 |
| 7432 | of 1890 | United Kingdom | 16/40 |
| 1407025 | 9/1975 | United Kingdom | 16/29 |

*Primary Examiner*—Peter M. Cuomo
*Assistant Examiner*—David E. Allred
*Attorney, Agent, or Firm*—Michael I. Kroll

[57] ABSTRACT

A portable picnic table comprising a tabletop with a first pair of legs extending downwardly from a first end of the tabletop at an angle and a second pair of legs extending downwardly from a second end of the tabletop at the same angle as the first pair of legs. Structures on the outer side faces near bottom ends of the first pair of legs are for rolling the first pair of legs along the ground, when the second end of the tabletop is lifted up by the hands of a person and then pushed by the hands of the person. Elements on the bottom ends of the second pair of legs are for raising the second pair of legs off the ground when at rest, to compensate for the rolling structures on the first pair of legs, so as to maintain the tabletop in a true horizontal level position.

1 Claim, 2 Drawing Sheets

Fig. 5
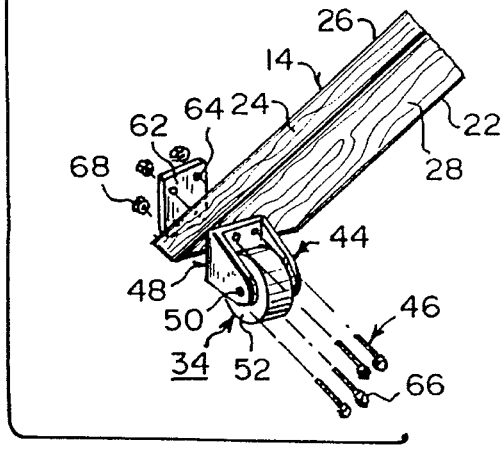
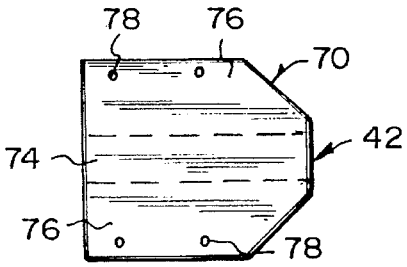
Fig. 6
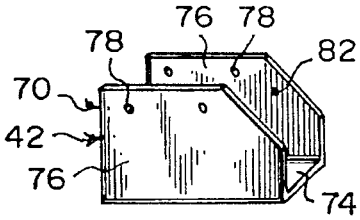
Fig. 7
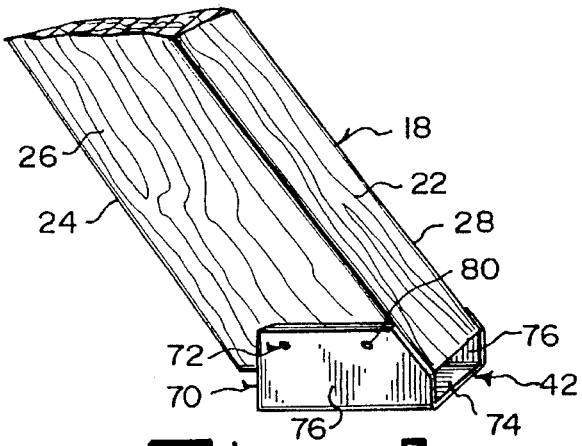
Fig. 8
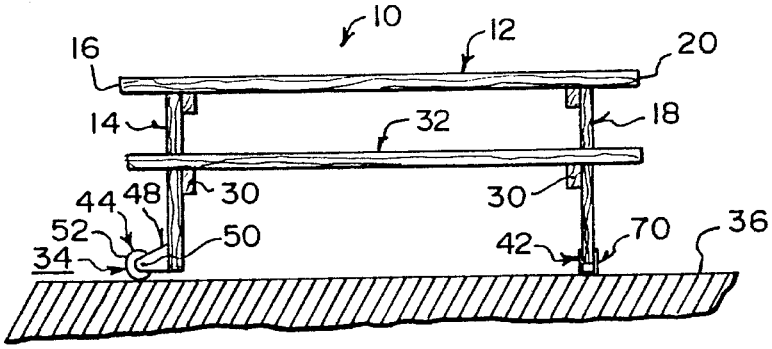
Fig. 9

PORTABLE PICNIC TABLE

BACKGROUND OF THE INVENTION

1. Field of the Invention

The instant invention relates generally to movable support structures and more specifically it relates to a portable picnic table.

2. Description of the Prior Art

Numerous movable support structures have been provided in prior art that are adapted to contain wheels, so that the structures can be moved from place to place. For example, U.S. Pat. Nos. 2,848,229 to Miller; 2,974,917 to Kappen; 4,974,284 to Campbell and 5,154,441 to White et al. all are illustrative of such prior art. While these units may be suitable for the particular purpose to which they address, they would not be as suitable for the purposes of the present invention as hereafter described.

MILLER, EDGAR E.

COMBINATION SAND BOX AND TABLE

U.S. Pat. No. 2,848,229

A combination sand box and table comprising a frame structure which includes a rectangular box-like member having opposite sidewalls, opposite end walls and a bottom. Paired supporting legs are fixed to the opposite end walls with the lower ends of each pair of legs being downwardly diverging. Blank seats are supported from the legs along the opposite side walls. A pair of lids form a cover for the box-like member. Standards are fixed to the opposite end walls. One of the pair of lids is hinged to each standard and against which the lids may be swung when raised to an open position. Latches on the standards are for holding the lids in an open position. The legs that extend to the same side are equipped with paired wheels to make movement from place to place relatively easy.

KAPPEN, JOHN W.

PALLET

U.S. Pat. No. 2,974,917

A pallet, includes a bed portion with a batten fastened to the underside of the bed portion. The batten has a longitudinal planar slot which is intermediate the ends of the batten and is formed with a vertically enlarged portion. A removable support includes a retainer plate mounted in and removed from the batten by way of the slot and is received in the enlarged portion with freedom of motion above and below the plane of the slot. The pallet is equipped as described alternatively with supporting legs or wheels or a combination of the two.

CAMPBELL, JOHN

PICNIC TABLE CASTER ASSEMBLY

U.S. Pat. No. 4,974,284

A wheel assembly and a picnic table with the wheel assembly attached thereto includes a bracket which has an arm portion and a mounting flange portion. The mounting flange portion is inclined at an angle of about sixty five degrees with respect to the longitudinal extent of the upper edge of the arm portion. The flange portion is attached to inner face of the leg or the article of furniture such that the wheel which is located at the distal end of the arm portion is in close proximity to the underlying support surface. When attached to the leg of the article of furniture, the wheel is aligned with a side edge of the leg, so that it does not form an obstruction which would be encountered by the legs of a person seated on the furniture in use.

WHITE, RICHARD W.

WHITE, ROBERT J.

FOLDING AND ROLLING TWO SURFACE TABLE

U.S. Pat. No. 5,154,441

A two tier, rolling and folding table has a top planar platform supported at one end by a U-shaped first leg assembly connected to the platform by fixed pivots and supported at another end by a pair of legs of a second leg assembly connected to the platform by a sliding pivot bar that slides in guide slots and latches in an open position. The legs of first and second leg assemblies mutually and pivotally intersect intermediate their ends. A bottom planar platform with handle is supported at one end by fixed pivot connections to the U-shaped leg assembly, and at another end by fixed pivot connections to the parallel members of a wheeled leg assembly carrying a pair of wheels. The legs connected to the sliding bar pass freely through slots in the bottom platform and pivotally connect to the vertical members of the wheeled leg assembly to lock the wheels in an open position. When the latches are disengaged, the top platform fold down upon the bottom platform and the legs force the wheeled assembly forward to form a flat package that is easily wheeled about. The wheeled leg assembly is easily disengaged from the legs to fold flat beneath the platform for a second, most compact, storage position.

SUMMARY OF THE INVENTION

A primary object of the present invention is to provide a portable picnic table that will overcome the shortcomings of the prior art devices.

Another object is to provide a portable picnic table, in which one end of the table can be lifted, so that two legs at an opposite end can be rolled along the ground by wheel assemblies.

An additional object is to provide a portable picnic table, in which two legs of the table can be raised off the ground by foot brackets when at rest to compensate for the wheel assemblies, mounted to the two legs on the opposite end, so that the table will maintain a true horizontal level position.

A further object is to provide a portable picnic table that is simple and easy to use.

A still further object is to provide a portable picnic table that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 5 is an exploded perspective view taken in the direction of arrow 5 in FIG. 1, of the wheel assembly ready to be mounted to a leg.

FIG. 6 is a flat open plan view of one of the foot brackets.

FIG. 7 is a perspective view of the foot bracket bent into shape.

FIG. 8 is an enlarged perspective view as indicated by arrow 8 in FIG. 1, showing one foot bracket in greater detail mounted to a leg.

FIG. 9 is a side view taken in the direction of arrow 9 in FIG. 1.

DETAILED DESCRIPTION OF THE PREFERRED EMBODIMENTS

Figure 1:
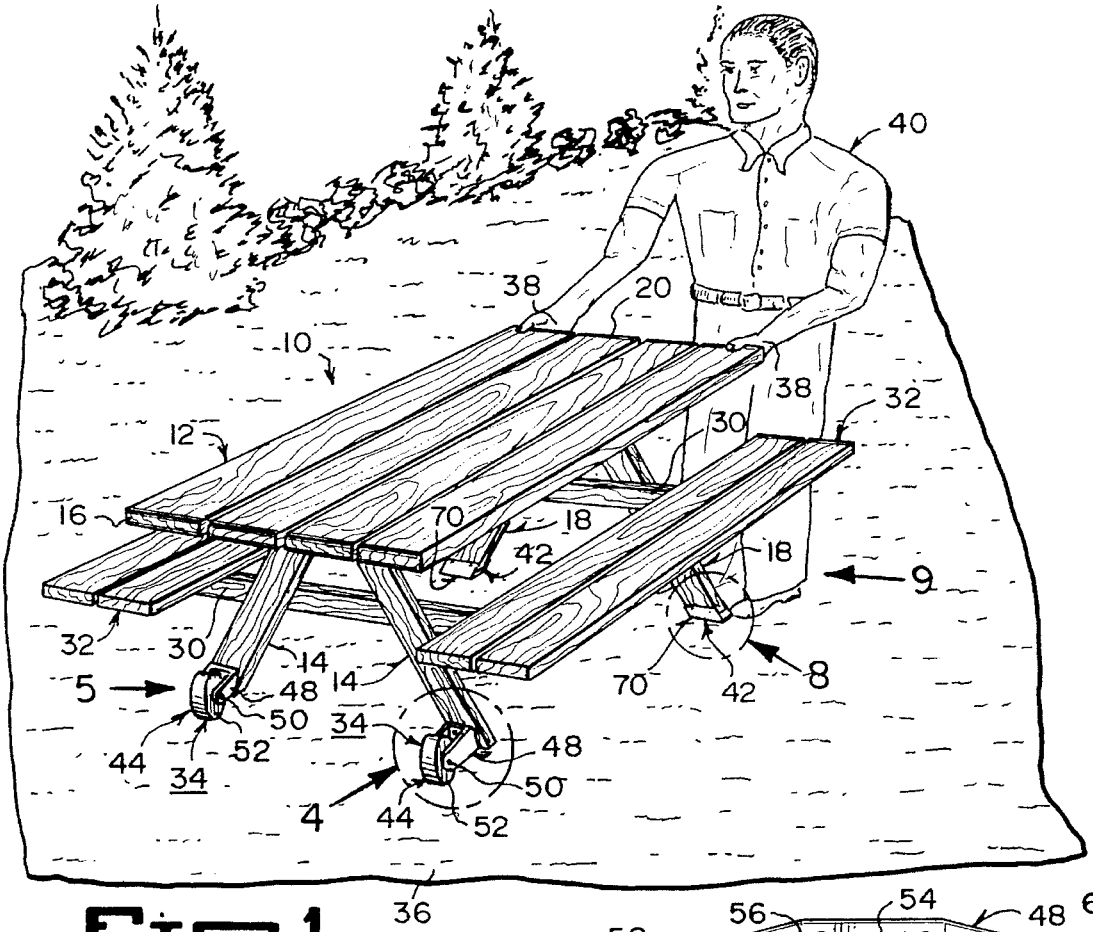
FIG. 1 is a perspective view of the instant invention ready to be lifted on one end and moved by a person.
Figure 2:
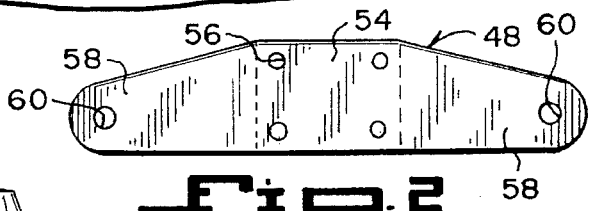
FIG. 2 is a flat open plan view of one of the wheel brackets.
Figure 4:
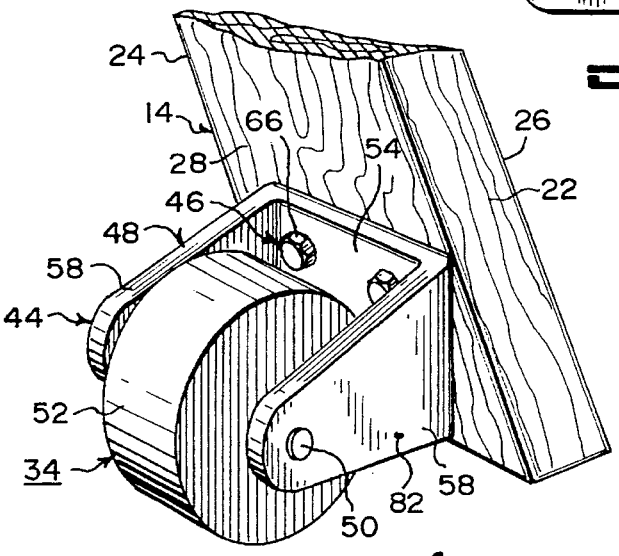
FIG. 4 is an enlarged perspective view as indicated by arrow 4 in FIG. 1, showing one wheel assembly in greater detail mounted in place to a leg.
Figure 3:
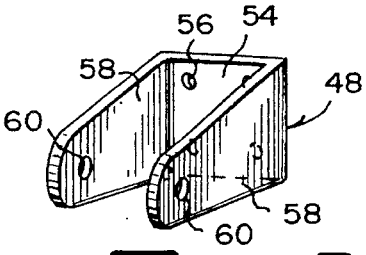
FIG. 3 is a perspective view of the wheel bracket bent into shape.

Turning now descriptively to the drawings, in which similar reference characters denote similar elements throughout the several views, FIGS. 1 through 9 illustrate a portable picnic table 10 comprising a tabletop 12. A first pair of legs 14 extend downwardly from a first end 16 of the tabletop 12 at an angle, so as to diverge toward opposite sides of the tabletop 12. A second pair of legs 18 extend downwardly from a second end 20 of the tabletop 12 at the same angle as the first pair of legs 14.

Each leg of each pair of legs 14, 18 have a front face 22, a back face 24, an inner side face 26 and an outer side face 28 defining a rectangular cross sectional configuration, in which the side faces 26, 28 are wider than the front and back faces 22, 24. A pair of crossbars 30 are for maintaining the first and second pair of legs 14, 18 in spaced relationships. A pair of bench boards 32 are provided, with each extending between the ends of the crossbars 30 below the opposite sides of the tabletop 12. Structures 34 on the outer side faces 28 near bottom ends of the first pair of legs 14, are for rolling the first pair of legs 14 along the ground 36, when the second end 20 of the tabletop is lifted up by the hands 38 of a person 40 and then pushed by the hands 38 of the person 40.

Elements on the bottom ends of the second pair of legs 18 are for raising the second pair of legs 18 off the ground 36 when at rest. This compensates for the rolling structures 34 on the first pair of legs 14, so as to maintain the tabletop 12 in a true horizontal level position.

The rolling structures 34 include a pair of wheel assemblies 44. Units 46 are for securing the wheel assemblies 44 to the outer side faces 28 near the bottom ends of the first pair of legs 14. Each wheel assembly 44 contains a wheel bracket 48, an axle 50 carried in the wheel bracket 48 and a wheel 52 rotatively mounted on the axle 50. Each wheel bracket 48 consists of a central portion 54, having a plurality of apertures 56 therethrough. A pair of arm portions 58 are provided. Each arm portion 58 is integral with and extends at a right angle from the central portion 54. Each arm portion 58 has a hole 60 therethrough at a distal end to receive the axle 50.

Each securing unit 46, as best seen in FIG. 5, includes a backing plate 62 having a plurality of apertures 64 therethrough, which align with the apertures 56 in the central portion 54 of one wheel bracket 48, when the backing plate 62 is placed against the inner side face 26 of the leg 14 having a plurality of aligned bores therethrough. A pair of bolts 66 are provided. Each bolt 66 extends through one aperture 56 in the central portion 54 of the wheel bracket 48, one bore in the leg 14 and one aperture 56 in the backing plate 62. A plurality of nuts 68 are also provided. Each nut 68 engages with one bolt 66, so as to hold the wheel bracket 48 to the leg 14.

The raising elements 42 consists of a pair of foot brackets 70. Components 72 are for attaching the foot brackets 70 to the bottom ends of the second pair of legs 18. Each foot bracket 70 contains a base portion 74 and a pair of side portions 76, each integral with and extending at a right angle from the base portion 74. Each side portion 76 has a plurality of openings 78 therethrough.

The attaching components 72 are a plurality of fasteners 80. Each fastener 80 extends through one opening 78 in each side portion 76, after the foot bracket 70 is placed upon the bottom end of the leg 18 with the side portions 76 against the inner side face 26 and the outer side face 28 of the leg 18.

Each wheel assembly 44 and each foot bracket 70 are fabricated out of a durable non-corrosive, strong metal material 82, such as stainless steel and the like.

| LIST OF REFERENCE NUMBERS | |
|---|---|
| 10 | portable picnic table |
| 12 | tabletop |
| 14 | first leg |
| 16 | first end of 12 |
| 18 | second leg |
| 20 | second end of 12 |
| 22 | front face of 14, 18 |
| 24 | back face of 14, 18 |
| 26 | inner side face of 14, 18 |
| 28 | outer side face of 14, 18 |
| 30 | crossbar |
| 32 | bench board |
| 34 | rolling structure for 14 |
| 36 | ground |
| 38 | hand |
| 40 | person |
| 42 | raising element for 18 |
| 44 | wheel assembly |
| 46 | securing unit |
| 48 | wheel bracket |
| 50 | axle |
| 52 | wheel |
| 54 | central portion of 48 |
| 56 | aperture in 54 |
| 58 | arm portion of 48 |
| 60 | hole in 58 |
| 62 | backing plate |
| 63 | aperture in 62 |
| 66 | bolt |
| 68 | nut |
| 70 | foot bracket |
| 72 | attaching component |
| 74 | base portion of 70 |
| 76 | side portion of 70 |
| 78 | opening in 76 |
| 80 | fastener for 72 |
| 82 | durable, non-corrosive, strong metal material |

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A portable picnic table comprising:

a) a tabletop having first and second ends and a pair of connecting side;

b) a first pair of legs extending downwardly from said first end of said tabletop at an angle, so as to diverge toward the opposite connecting sides of said tabletop;

c) a second pair of legs extending downwardly from said second end of said tabletop at the same angle as said first pair of legs;

d) each said leg of each said pair of legs having a front face facing one connecting side of said tabletop, a back face facing the opposite connecting side of said tabletop, an outer side face facing the adjacent end of said tabletop, an inner side face opposite said outer side face, said faces defining a rectangular cross sectional configuration, in which said side faces are wider than said front and back faces;

e) means comprising a pair of crossbars for maintaining said first and second pair of legs in spaced relationships;

f) a pair of bench boards, each extending between the ends of said crossbars below the opposite sides of said tabletop;

g) means on said outer side faces near bottom ends of said first pair of legs for rolling said first pair of legs along the ground when the second end of said tabletop is lifted up by the hands of a person and then pushed by the hands of the person, said rolling means including a pair of wheel assemblies and means for securing said wheel assemblies to said outer side faces near the bottom ends of said first pair of legs such that said wheels extend a distance below said first pair of legs whereby the first end of said tabletop is supported directly by said rolling means, each wheel assembly including a wheel bracket, an axle carried in said wheel bracket, and a wheel rotatively mounted on said axle, each wheel bracket including a central portion having a plurality of apertures therethrough and a pair of arm portions integral with and extending at a right angle from said central portion, each said arm portion having a hole therethrough at a distal end to receive said axle, each said securing means including a backing plate on each of the inner faces of said first pair of legs, each said backing plate having a plurality of apertures therethrough which align with said apertures in said central portion of one said wheel bracket and apertures formed in each said first leg, and a plurality of bolts extending through the aligned apertures in said bracket, first leg, and said bracket, with a nut engaging each of said bolts to hold said wheel bracket on said first leg;

h) means on the bottom ends of said second pair of legs for raising said second pair of legs off the ground when at rest to compensate for said rolling means on said first pair of legs to maintain said tabletop in a true horizontal level position, said raising means including a pair of foot brackets and means for attaching said foot brackets to the bottom ends of said second pair of legs, each foot bracket comprising a base portion for resting on the ground surface and spaced from a bottom end of each of said second pair of legs and a pair of side portions each integral with and extending at a right angle from said base portion, each fixed and said side portion having a plurality of openings therethrough to accommodate fasteners passing through said openings into said second pair of legs.

* * * * *